US006591513B1

(12) United States Patent
Schnaus et al.

(10) Patent No.: US 6,591,513 B1
(45) Date of Patent: Jul. 15, 2003

(54) APPARATUS AND METHOD OF ALIGNING AN EDGE OF A TEXTILE MATERIAL WEB

(75) Inventors: Martin Schnaus, Bad Koenigshofen-Eyershausen (DE); Dieter Koeberlein, Grosseibstadt (DE)

(73) Assignee: Texpa Maschinenbau GmbH & Co. KG (DE)

( * ) Notice: Subject to any disclaimer, the term of this patent is extended or adjusted under 35 U.S.C. 154(b) by 184 days.

(21) Appl. No.: 09/632,141

(22) Filed: Aug. 3, 2000

(30) Foreign Application Priority Data

Jun. 5, 2000 (DE) ..... 200 09 773 U

(51) Int. Cl.[7] ..... D05B 35/02; D05B 27/10

(52) U.S. Cl. ..... 33/645; 112/141; 112/147; 112/475.03

(58) Field of Search ..... 33/645, 613, 619, 33/620, 623, 2 R, 17 R, 2 H; 271/239, 234; 112/475.03, 470.16, 470.07, 141, 143, 147, 153, 470.06, 307, 306

(56) References Cited

U.S. PATENT DOCUMENTS 3,906,878 A * 9/1975 Burton ..... 112/423
4,271,767 A * 6/1981 Burton et al. ..... 112/2
4,292,908 A * 10/1981 Blessing ..... 112/306
4,425,858 A * 1/1984 Hargett ..... 112/470.04
4,483,262 A * 11/1984 Keeton ..... 112/470.07
4,621,585 A * 11/1986 Ball et al. ..... 112/10
4,624,198 A * 11/1986 Beam et al. ..... 112/10
4,693,460 A * 9/1987 Adamson et al. ..... 271/10.05
4,825,787 A * 5/1989 Babson et al. ..... 112/475.03
4,856,439 A * 8/1989 O'Neal et al. ..... 112/10
4,962,712 A * 10/1990 Sotome et al. ..... 112/305
5,054,409 A * 10/1991 Schips ..... 112/306
5,133,273 A * 7/1992 Brocklehurst ..... 112/470.13
5,152,235 A * 10/1992 Goto et al. ..... 112/63
5,216,969 A * 6/1993 Thomas et al. ..... 112/7
5,226,378 A * 7/1993 Suzuki et al. ..... 112/470.02
5,257,591 A * 11/1993 Suzuki et al. ..... 112/470.07
5,290,027 A * 3/1994 Clanton et al. ..... 271/227
5,415,118 A * 5/1995 Adamski et al. ..... 112/470.03
5,476,053 A * 12/1995 Brocklehurst ..... 112/475.06
5,522,332 A * 6/1996 Price et al. ..... 112/470.29
5,540,166 A * 7/1996 Wiley ..... 112/475.03
5,865,135 A * 2/1999 Price et al. ..... 112/475.06
5,992,340 A * 11/1999 Rombold ..... 112/475.03
6,347,596 B1 * 2/2002 Koeberlein et al. ..... 112/141

* cited by examiner

*Primary Examiner*—Diego Gutierrez
*Assistant Examiner*—R. Alexander Smith
(74) *Attorney, Agent, or Firm*—McGlew and Tuttle, P.C.

(57) ABSTRACT

The invention relates to an apparatus (40) and a method of aligning an edge (7) of a textile material web (43). Said material web (43) is delivered so as to lie at least in sections flat on top of a work surface (10) and, while lying on the work surface (10), is conveyed in a conveying direction (9) by means of a conveying device (11, 12*a*, 12*b*). An adjusting member (46, 47) is applied from above at least in sections against the material web (43) in the course of conveying in conveying direction (9) in the region of at least one edge (7) extending parallel to the conveying direction (9), wherein the material web (43) is at least slightly pressed between adjusting member (46, 47) and work surface (10). The adjusting member (46, 47) is, on the one hand, displaceable synchronously with the conveying motion of the material web (43) parallel to the conveying direction (9). At the same time, the adjusting member (46, 47) is displaceable at right angles to the conveying direction (9) for alignment, at least in sections, of the edge (7) of the material web (43).

18 Claims, 3 Drawing Sheets

APPARATUS AND METHOD OF ALIGNING AN EDGE OF A TEXTILE MATERIAL WEB

FIELD OF THE INVENTION

The invention relates to an apparatus and a method of aligning an edge of a textile material web according to the preamble of the independent main claims.

BACKGROUND OF THE INVENTION

When manufacturing textile workpieces, e.g. hand towels or bed linen, the edges of the material web to be processed are in many cases required to be aligned as precisely as possible. This is necessary particularly, but by no means exclusively, for hemming of a material web because it is only by feeding the edge as precisely as possible into the hemming device that a cleanly stitched hem may be obtained. As it is, in principle, immaterial to the application of the invention whether the material web is continuous or material portions cut to a specific length and/or width are to be processed, in the following only the generic term, material web, is used.

For aligning the edges of textile material webs, apparatuses are known from prior art, which comprise frictional wheels movable from below into frictional engagement with a material web in the region of its edges. The frictional wheels are in said case disposed in such a way as to be supported radially at a specific angle, e.g. 45°, to the conveying direction of the material web so as to be rotatable about an axis of rotation, with the result that at least a specific component of the applied frictional force acts at right angles to the conveying direction upon the material web. By means of the component of frictional force applied at right angles to the conveying direction the material web may be displaced at right angles to the conveying direction so that the edge of the material web may be aligned at right angles to the conveying direction, e.g. in dependence upon the rotational speed or the contact pressure of the frictional wheel.

A drawback of the known apparatuses for aligning the edges of a material web is that, in order to apply the frictional force, the material web has to be at least slightly pressed between the frictional wheel and an oppositely arranged counterpressure element, e.g. a pressure belt applied from above against the material web. The pressing of the material web between frictional wheel and counterpressure element impedes the actually desired alignment motion because the material web between frictional wheel and counterpressure element has to be pulled out at right angles to the conveying direction. Furthermore, the material web because of the impeding of the alignment motion in the region of the frictional forces, which are applied by the frictional wheel and directed at right angles to the conveying direction, has a tendency to form creases, which in particular may prevent trouble-free operation of hemming devices. With the known apparatuses and methods, moreover, materials which do not rest substantially in a completely crease-free manner on the work surface may not be aligned with the required accuracy and at the required speed. For instance, problems arise particularly when hemming materials having a creased ruched band.

From DE 200 09 773 an apparatus is known, by means of which particularly materials having a creased ruched band may be conveyed in a straightened form. To said end, the apparatus comprises contact pressure elements, which may be applied from above against the material and displaced synchronously with the conveying speed in the direction of the conveying motion.

SUMMARY OF OBJECTS OF THE INVENTION

The object of the present invention is to propose an apparatus and a method, by means of which the drawbacks of prior art are avoided when aligning the edges of a material web.

According to the invention, the apparatus is provided with at least one adjusting member, which may be applied from above against the material web in the region of an edge extending parallel to the conveying direction. Said adjusting member is displaced towards the work surface until the material portion is at least slightly pressed between adjusting member and work surface. As soon as the adjusting member rests against the material web, it is on the one hand displaced synchronously with the conveying motion of the material web parallel to the conveying direction so that the conveying motion of the material web in conveying direction is not impeded by the adjusting member. At the same time, for alignment of the edge of the material web the adjusting member may be displaced at right angles to the conveying direction so that the edge of the material web at the one side of the adjusting member is laterally offset at right angles to the conveying direction and at the same time the material web at the other side of the adjusting member curves up possibly with simultaneous formation of a longitudinal fold. In said case, depending on the stiffness of the material web used it may happen that the material web, particularly in the event of larger adjusting motions of the adjusting member, in the absence of support from below does not actually curve up but drops back into the plane of the work surface so as to form longitudinal folds.

The adjusting members may in principle be of any desired structural design. Particularly advantageous configurations arise when the adjusting members are structurally designed in accordance with the described contact pressure elements and disposed in the apparatus. In said case, it is naturally conceivable to use the contact pressure elements described in DE 200 09 773 and adjusting members according to the invention simultaneously in one apparatus.

The adjusting members according to the invention are particularly suitable for aligning material portions having special properties, such e.g. ruched bands. When the material portion to be aligned is composed of a plurality of materials, e.g. a smooth material having a ruched band stitched thereon, further adjusting members in addition to the adjusting members according to the invention may be provided in the apparatus. The edge of the material portion e.g. in the region of the ruched bands is then aligned by the adjusting members according to the invention and the additional adjusting member is used to align the edge of the smooth material. All adjusting members for aligning a material edge, such as are known from prior art, may be considered as an additional adjusting member.

According to the invention, a fixing of the material web in the region of the edges to be aligned, e.g. by means of pressure belts applied from above, is not absolutely essential prior to alignment of the edge. So that the edge to be aligned is prevented from slipping after alignment at the adjusting member and may therefore be conveyed even over extended distances in the required position to downstream work stations, e.g. a hemming device, it is particularly advantageous when the apparatus is provided with a fixing device, by means of which the position of the edge at right angles to the conveying direction may be fixed.

Said fixing device may be designed in a particularly simple manner as a continuous-loop pressure belt, which extends parallel to the conveying direction and which may be applied in conveying direction in the region downstream of the adjusting member from above against the material web so as to fix the position of the material web in the region of the aligned edge.

It is further advantageous when, for fixing the pressure belt against the aligned edge of the material web, use is made of a pressure roller, which presses the pressure belt in the direction of the work surface against the material portion.

For checking the position of the edge to be aligned upstream and/or downstream of the alignment at the adjusting member, position sensors may be disposed in the apparatus upstream and/or downstream of the adjusting member. Such position sensors are known from prior art and may be designed, for example, in the manner of inductive pickups or in the manner of one or more photoelectric barriers. In order to be able to align the material edge at any time automatically without intervention by minding personnel, a control and/or closed-loop control device may be provided on the apparatus. Said control and/or closed-loop control device receives, as input signals, the measuring signals of one of more position sensors disposed upstream and/or downstream of the adjusting member. In dependence upon the difference between a preset setpoint position of the edge to be aligned and the actual position measured upstream and/or downstream of the adjusting member, the control and/or closed-loop control device calculates control commands for setting the adjusting member. Which control or controller algorithms are used in said case depends on the respective application, the choice being in principle free. For example, P, PD or PID controllers may be used to correct the system deviation.

The use of the method according to the invention for alignment of the edge of a material portion is particularly advantageous when the edge, subsequent to alignment, is hemmed in a hemming device.

There now follows a detailed description of two embodiments of the invention which are illustrated in several drawings.

DETAILED DESCRIPTION OF THE PREFERRED EMBODIMENT

Figure 1:
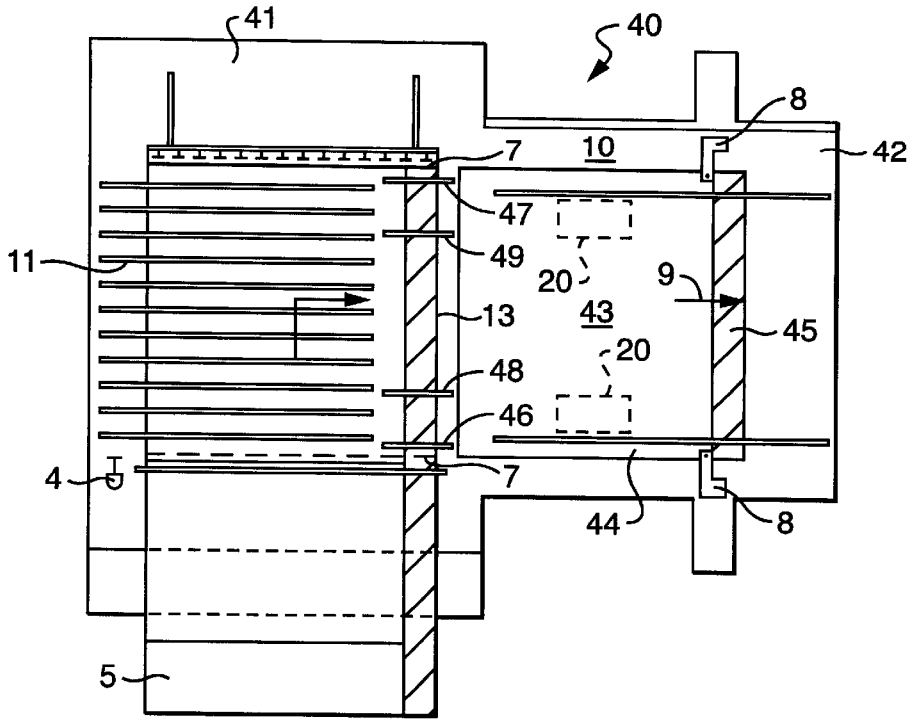
FIG. 1 an embodiment of an apparatus according to the invention in plan view.

In FIG. 1 an apparatus 40 for cutting and hemming material portions is shown, such as is known in principle e.g. also from DE 200 09 773. For the function of details of the apparatus 40, reference is made to the content of said printed publication. The apparatus 40 substantially comprises a first work station 41, in which material portions 43 are produced by being cut from an endless material 5 by means of a cutting device 4, and a second work station 42, in which two side edges 7 are hemmed by means of a hemming device 8. During hemming, the material portions 43 are conveyed in the direction of conveying direction 9, which extends parallel to the edges 7 which are to be hemmed. During conveying of the material portions 43, the latter lie flat on a work surface 10 and may be conveyed in the direction of conveying direction 9 by means of conveying devices 11 and/or 12*a* and 12*b* designed in the style of conveyor belts.

During transfer of the material portions 43 from work station 41 to work station 42, the front edge 13 of the material portions 43 is fixed by means of contact pressure elements 48 and 49 which are applied from above against the material portions 43, wherein by displacement of the contact pressure elements 48 and 49 the conveying of the material portions 43 in the direction of conveying direction 9 is enabled and/or assisted.

The material portions 43 to be processed in the apparatus 40 are formed by two material strips 43*a* and 43*b* which are sewn together, wherein the material strip 43*a* forms a ruched band fastened to the material strip 43*b*. Because of the creasing of the material strip 43*a* forming the ruches, the side edge 7 in the region of the material strip 43*a* is incapable of being aligned in accordance with prior art. For, because of the creasing in the material strip 43*a*, the edge 7 may not be reliably aligned by the vertical displacement of an adjusting member applied from below or from above.

For said reason, the apparatus 40 is provided with two adjusting members 46 and 47 designed in the manner of contact pressure elements which, like the contact pressure elements 48 and 49, may come to rest from above against the material strip 43*a*. For fixing the material strip 43 during the transfer from work station 41 to work station 42, the apparatus 40 is moreover provided with two contact pressure elements 48 and 49, which may be displaced synchronously with the conveying of the material portions 43 in conveying direction 9.

During the transfer of the material portions 43 from work station 41 to work station 42, the adjusting members 46 and 47 are also moved synchronously with the conveying motion of the material portions 43 in the direction of conveying direction 9. The adjusting member 46 and 47 may in said case simultaneously execute an adjusting motion at right angles to the conveying direction 9 towards the middle of the material portions 43 so that the edges 7 in the region of the material strips 43*a* may be drawn inwards and therefore aligned.

The alignment of the edge 7 to be aligned is effected only in the region of the front edge 13 of the material portion 43 by means of the adjusting members 46 and 47 because the adjusting members according to the invention are suitable in particular for aligning materials having special properties, such as e.g. ruches. For alignment of the edge 7 to be aligned along the remaining length up to the end of the material portion 43, i.e. in the region having properties which are determined by the material strip 43*b*, the apparatus 40 is provided with a straightening apparatus 20 having a second adjusting member 30 (FIG. 3). The straightening apparatus 20 is disposed below the work surface 10 and is merely diagrammatically indicated in FIG. 1 and FIG. 2.

Figure 2:
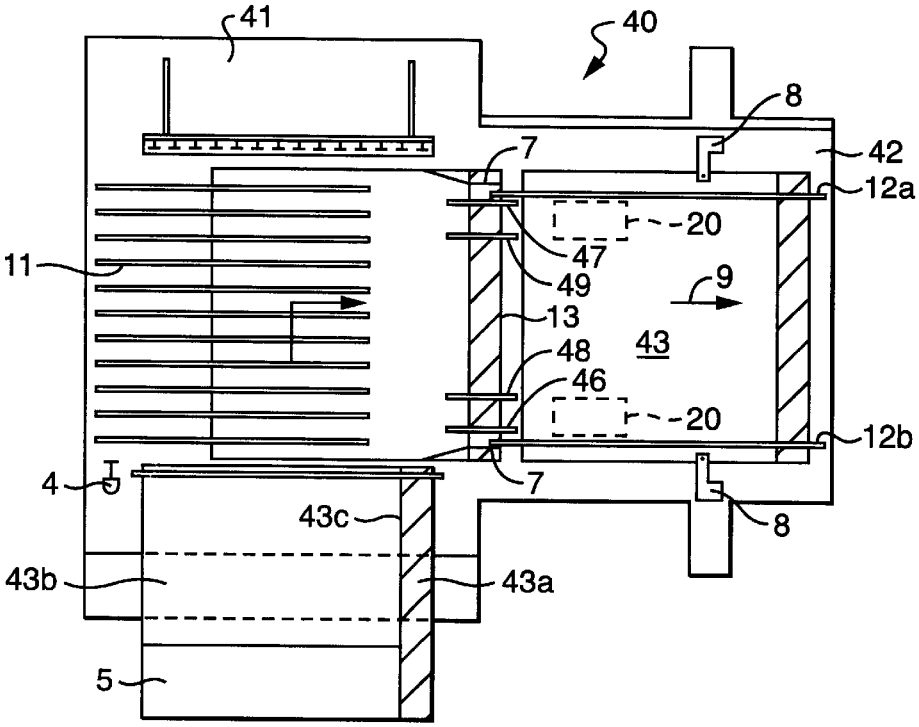
FIG. 2 the plan view of the embodiment according to FIG. 1 in a second processing phase.
Figure 3:
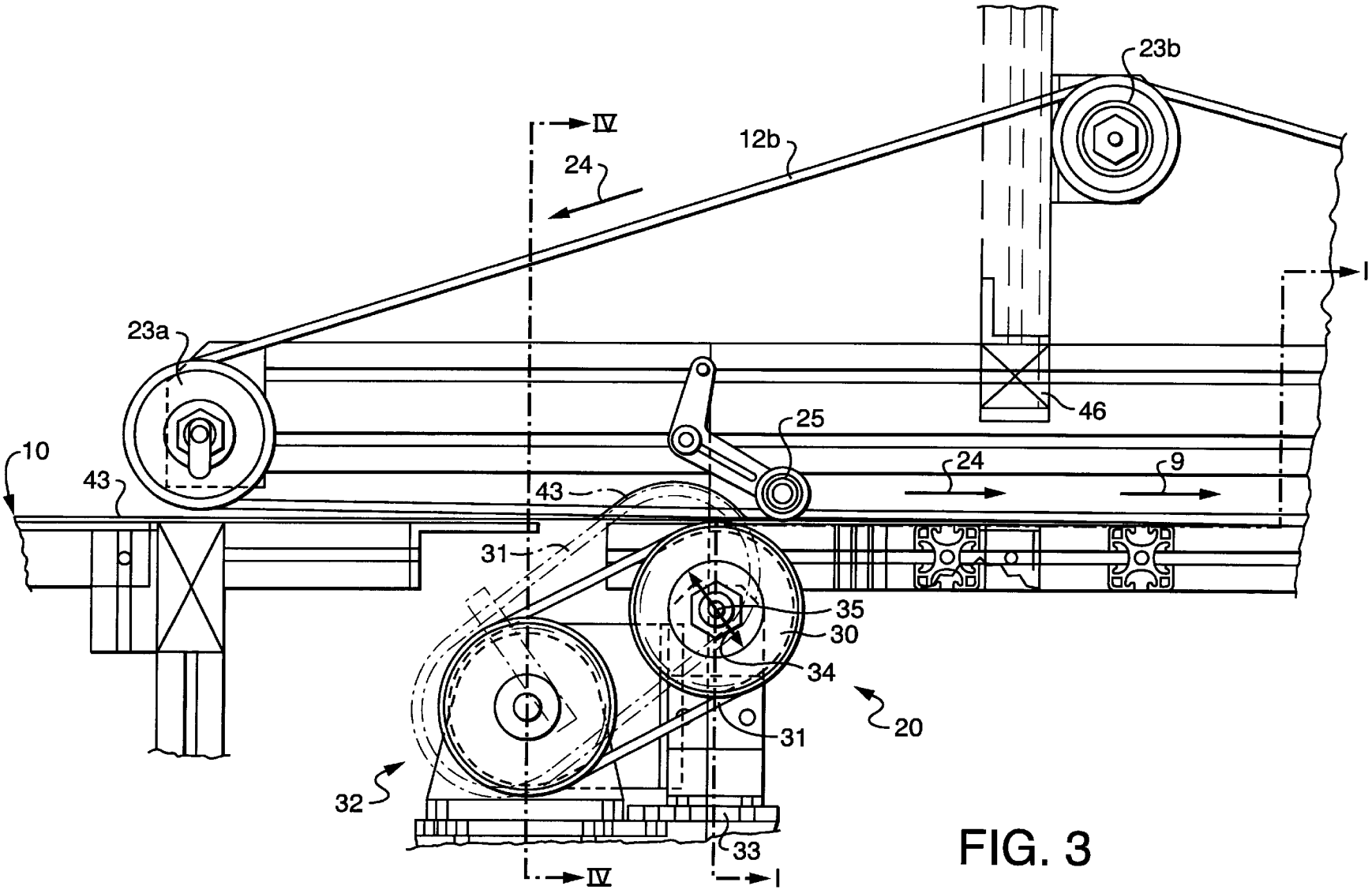
FIG. 3 an embodiment of an apparatus according to the invention in longitudinal section.

FIG. 2 shows the apparatus 40 in a later processing phase, in which the adjusting members 46 and 47 have already been displaced in the direction of the contact pressure elements 48 and 49. The resultant alignment of the edges 7 in the region of the material strips 43*a* is diagrammatically indicated in FIG. 2.

FIG. 3 shows a longitudinal section through the apparatus 40 in an enlarged cutout, wherein the length of the adjusting members 46 and 47 and of the contact pressure elements 48 and 49 in the direction of the conveying direction 9 in the illustrated embodiment is shorter than the length of the adjusting members 46 and 47 and contact pressure elements 48 and 49 shown in FIG. 1 and FIG. 2. The work surface 10 may be seen, which may be formed e.g. by a metal plate and on which the material portions 43 are laid flat from above. The conveyor belts 12*a* and 12*b* are supported so as to revolve on, in each case, a total of three guide pulleys 23, of which only two guide pulleys 23*a* and 23*b* are shown in FIG. 3, and may be driven by a non-illustrated drive motor in the direction of the movement arrows 24. Provided adjacent to each of the conveyor belts 12*a* and 12*b* disposed above the apparatus 40 is a plurality of contact pressure rollers 25, by means of which the conveyor belts 12*a* and 12*b* after alignment of the edge 7 are pressed towards the material portion 43 so that the edge 7 may no longer slide out of position after alignment and prior to hemming in the hemming device 8. The front guide pulley 23*a* is arranged a slight distance above the work surface 10 so that the material portions 43, when conveyed in conveying direction 9, may be drawn without difficulty into the gap between the conveyor belts 12*a* and 12*b* and work surface 10. A contact pressure roller 25 is only provided, in conveying direction 9, a specific distance downstream of the guide pulley 23*a* and presses the conveyor belt 12*b* towards the material portion 43 so that drive forces may be transmitted by frictional engagement from the conveyor belt 12*b* to the material portion 43. In said case, the material portion 43 under the conveyor belt 12*b* in cooperation with the pressure roller 25 is simultaneously fixed at right angles to the conveying direction 9.

As soon as the material portion 43 has been transferred far enough into the work station 42 for the edge 7 in the region of the material strip 43*a* to have been aligned by means of the adjusting members 46 and 47, the adjusting members 46 and 47 are lifted off and moved in the rear end position into a top inoperative position. The still lifted adjusting members 46 and 47 are then displaced counter to conveying direction 9 back to the front end position where they may be lowered again for alignment of the edge 7 of the next material portion. FIG. 3 shows the adjusting members 46 and 47 in the rear end position in the lifted state and situated one behind the other so that only the adjusting member 46 is visible. In FIG. 3 the contact pressure elements 48 and 49 have likewise reached their rear end position and are already lifted off the material web 43.

For aligning the edge 7 in the region of the material strip 43*b* the apparatus 40 is provided with a straightening apparatus 20, which is shown in side view in FIG. 3. In the illustrated embodiment, a circular pulley 30 is used as an additional second adjusting member, which is driven via a driving belt 31 by a drive motor 32.

The circular pulley 30 in the present case is supported in a frame 33 in such a manner around a swivelling axis that it may be swivelled radially relative to its centre line 35 in the direction of the movement arrow 34. In FIG. 3 the circular pulley 30 is shown in its basic position, in which the work surface 10 extends precisely tangentially to the uppermost point of the driving belt 31 so that the driving belt 31 is only just not yet in contact with the material portion 43. In FIG. 3, moreover, a second position of the circular pulley 30 is indicated by dash-dot lines, in which the circular pulley 30 has been displaced vertically upwards by being swivelled in the direction of the movement arrow 34. It is evident that the material portion 43 in the region of the circular pulley 30 may be lifted as a result of the lifting of the circular pulley 30 so that the material portion 43 in said region curves up and the edge 7, which is not shown in FIG. 3, is displaced towards the middle of the material portion 43. By means of said displacement the edge 7 may be aligned. By virtue of the pressing of the conveyor belt 12*b* against the material portion 43, the edge 7 after being aligned by means of the apparatus 20 is fixed, with the result that the conveyor belt 12*b* in cooperation with the contact pressure roller 25 operates both as a conveying device and as a fixing device.

Figure 4:
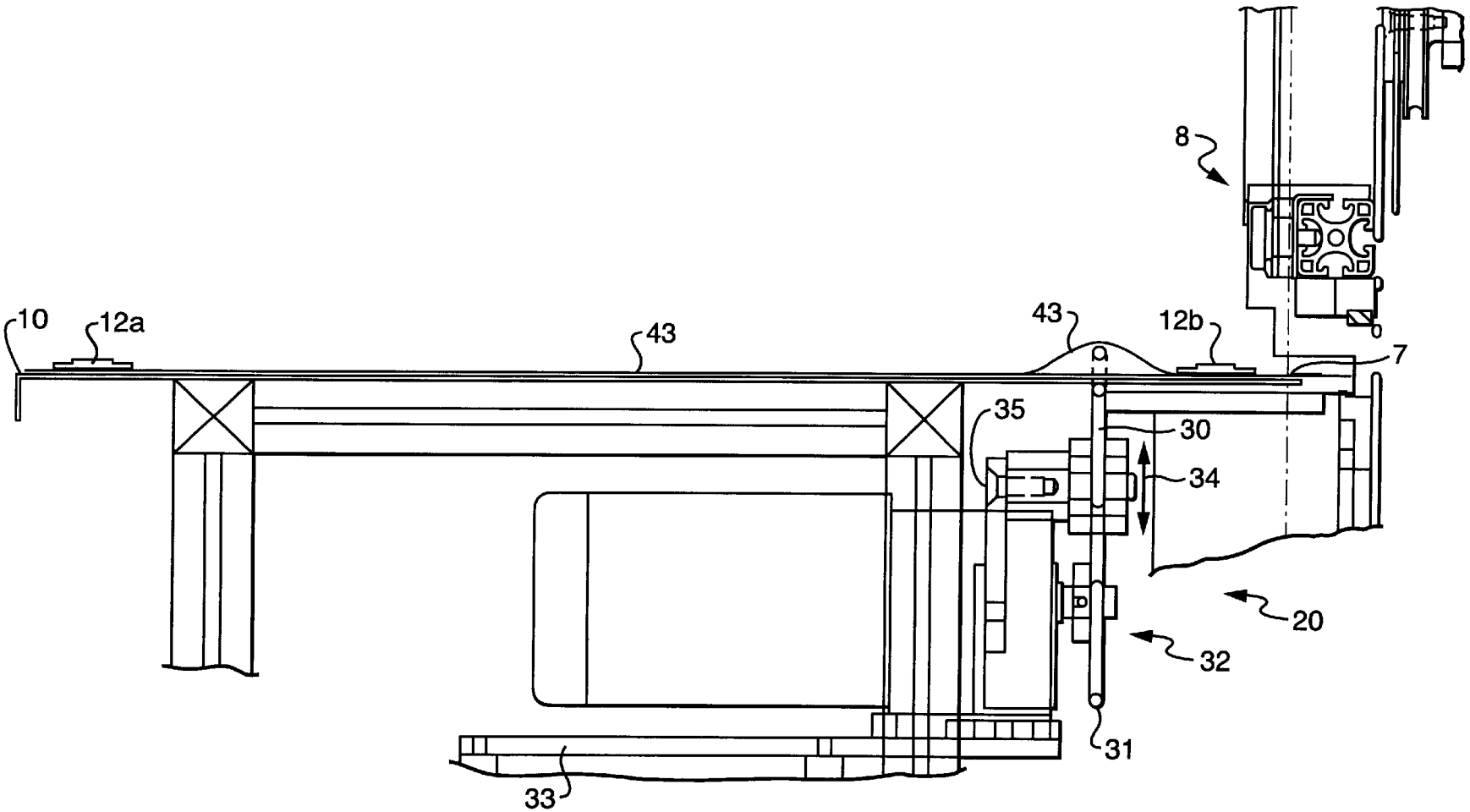
FIG. 4 the embodiment according to FIG. 3 in cross section along the cutting line IV—IV.

FIG. 4 shows the apparatus 20 in a cross section along the cutting line I—I (FIG. 3). Said view shows the material portion 43 resting flat on the work surface 10 and being conveyed in the direction of conveying direction 9 by means of the conveyor belts 12*a* and 12*b*, which are applied from above against the material portion 43. For hemming the edge 7 of the material portion 43, the edge 7 is fed through the hemming device 8 in the direction of conveying direction 9.

For aligning the edge 7, the circular pulley 30 may be swivelled up and down in accordance with the movement arrow 34. Depending on the swivelling angle of the circular pulley 30 the material portion 43 in said region is lifted to a differing extent by the driving belt 31, which is shown in section. Said function is illustrated in FIG. 4 once more by showing the apparatus 20 on the one hand in its basic position, in which the driving belt does not come into contact with the material portion 43, and on the other hand in an upwardly displaced position, in which the material portion 43 is curved out in an upward direction.

What is claimed is:

1. An apparatus for aligning an edge of a textile material web, the apparatus comprising:

a work surface supportable of the material web at least in sections so as to lie flat thereon;

a conveying device, by means of which the material web lying on the work surface is conveyable in a conveying direction;

at least one adjusting member applied against the material web in the course of conveying in said conveying direction in the region of at least one edge extending parallel to the conveying direction, wherein the material web is at least slightly pressed between said adjusting member and said work surface, and wherein said adjusting member is displaceable synchronously with the conveying motion of the material web parallel to the conveying direction and is simultaneously displaceable at right angles to the conveying direction for alignment, at least in sections, of the edge of the material web, said material web being formed by first and second material strips, which are joined along a seam extending substantially at right angles to the conveying direction of the conveying device, wherein the adjusting member is is movably disposed from above against the first material strip.

2. An apparatus according to claim 1, wherein said adjusting member is disposed in such a way that it is appliable from above against a side edge of the material web.

3. An apparatus according to claim 1, wherein said conveying device includes at least one conveyor belt in a first end position, said adjusting member is disposed in such a way as to have at least a slight overlap in the conveying direction with said at least one conveyor belt in a first end position.

4. An apparatus according to 1, wherein the first material strip is stitched to the second material strip with simultaneous formation of a plurality of folds and the first material strip is pressed flat against the work surface by the adjusting member.

5. An apparatus according to claim 1 wherein an extension of the adjusting member in the conveying direction corresponds at least to a width of the first material strip in the conveying direction.

6. An apparatus according to claim 1, wherein in addition to said first adjusting member a second adjusting member is provided in the apparatus;

said adjusting members are linearly movable in said conveying direction and in said right angels to said conveying direction.

7. An apparatus according to claim 1, further comprising a fixing device for fixing the position of the edge to be aligned at right angles to the conveying direction after the alignment at least in sections.

8. An apparatus according to claim 7, wherein the fixing device is a continuous loop pressure belt extending in parallel to the conveying direction and being applied from above against the material web so as to fix the position of the material web in the region of the aligned edge.

9. An apparatus according to claim 8, further roller, wherein said pressure belt is pressable by said pressure roller in the direction of the work surface against the material web.

10. An apparatus according to claim 1, further comprising a position sensor, wherein a position of the edge to be aligned at right angles to the conveying direction is detectable one of upstream and downstream of the adjusting member by said position sensor;

said adjusting member is movable in its entirety in said conveying and right angle direction;

said adjusting member has a contact surface in contact with the material web;

said contact surface moves with the material web in said conveying and right angle directions;

said contact surface is rotationally fixed with respect to the material web.

11. An apparatus according to claim 1, further comprising a control device for varying the traverse path of the adjusting member at right angles to the conveying direction in dependence upon the difference between a preset setpoint position of the edge to be aligned and the measured actual position in accordance with a preset control or controller algorithm.

12. An apparatus according to claim 1, wherein at least one contact pressure element is movable from above at least in sections against the material web in the course of conveying in the conveying direction, wherein the material web is at least slightly pressed between said contact pressure element and work surface, and wherein the contact pressure element is displaceable synchronously with the conveying motion of the material web parallel to the conveying direction.

13. An apparatus for aligning an edge of a textile material web, the apparatus comprising:

a work surface supportable of the material web at least in sections so as to lie flat thereon;

a conveying device, by means of which the material web lying on the work suface is conveyable in a conveying direction;

a first adjusting member applied against the material web in the course of conveying in said conveying direction in the region of at least one edge extending parallel to the conveying direction, wherein the material web is at least slightly pressed between said adjusting member and said work surface, and wherein said adjusting member is displaceable synchronously with the conveying motion of the material web parallel to the convening direction and is simultaneously displaceable at right angles to the convoying direction for alignment, at least in sections, of the edge of the material web, said first adjusting member aligning the start of the edge to be aligned in the region of the front edge of the material web;

a second adjusting member aligning the edge to be aligned along the remaining length up to the end of the material web.

14. An apparatus according to claim 13, wherein said second adjusting member extends substantially parallel to the conveying direction of the material webs, obliquely upwards or downwards from the plane of the work surface, in the conveying direction and, in the course of conveying of the material web in the conveying direction, is movable from one of below or above at least in sections against the material web.

15. An apparatus according to claim 13, wherein said second adjusting member is supported so as to be at least vertically adjustable and slewable.

16. An apparatus according to claim 13, wherein said second adjusting member is a rotatably supported circular pulley, which is disposed below or above the work surface so as to extend radially in the conveying direction, wherein the circular pulley is applied by its periphery from below or from above against the material web, and wherein the center line of the circular pulley is supported so as to be adjustable radially in vertical direction.

17. An apparatus according to claim 13, further comprising a driving device wherein said second adjusting member is drivable by means of said driving device.

18. An apparatus according to claim 13, further comprising a continuous-loop driving member disposed on a periphery of the second adjusting member comprising at least one of a driving belt or driving chain, which is drivable by a drive motor and is movable from one of below or above against the material web so as to drive the material web in the conveying direction.

* * * * *